United States Patent [19]

Brandauer et al.

[11] 4,157,794

[45] Jun. 12, 1979

[54] DEVICE AND METHOD FOR ROLLING UP CONTINUOUS SHEETS

[75] Inventors: Kurt Brandauer, Giengen; Heinrich Flaig, Heidenheim; Franz Krautzberger, Heidenheim-Grosskuchen; Friedrich Kuhn, Heidenheim; Günter Rohde, Heidenheim; Hartmut Waldvogel, Heidenheim; Robert Wolf; Georg Honold, both of Herbrechtingen, all of Fed. Rep. of Germany

[73] Assignee: J. M. Voith GmbH, Fed. Rep. of Germany

[21] Appl. No.: 826,465

[22] Filed: Aug. 22, 1977

[30] Foreign Application Priority Data

Aug. 26, 1976 [DE] Fed. Rep. of Germany ..... 2638368

[51] Int. Cl.[2] ..... B65H 17/08

[52] U.S. Cl. ..... 242/66

[58] Field of Search ..... 242/65, 66, 67.1 R, 242/67.2, 156, 156.2

[56] References Cited

U.S. PATENT DOCUMENTS

| | | | |
|---|---|---|---|
| 3,848,826 | 11/1974 | Voswinckel | 242/66 |
| 3,937,410 | 2/1976 | Justus | 242/66 |

*Primary Examiner*—Leonard D. Christian

*Attorney, Agent, or Firm*—Ostrolenk, Faber, Gerb & Soffen

[57] ABSTRACT

A rolling device for rolling up a sheet onto roll formers or spools: a roll former is inserted between and supported on two supporting rollers and a sheet is wound on it; the finished wound roll on its roll former is lifted off one of the supporting rollers looping the sheet, and the slack loop section is stapled to the next roll former; the sheet is cut off at the new roll former.

23 Claims, 3 Drawing Figures

M1
M2

DEVICE AND METHOD FOR ROLLING UP CONTINUOUS SHEETS

BACKGROUND OF THE INVENTION

The invention relates to a rolling device for forming separate rolls from a continuous sheet, particularly a paper sheet, which device is used in a roll cutting machine and wherein the device includes two supporting rollers for carrying each roll as it is being wound.

These rolling devices are used, for instance, to form separate smaller rolls from larger storage rolls. Where roll cutting machines are used at the same time as the rolling device, a continuous sheet is drawn from a storage roll, is cut longitudinally by the roll cutting machine into separate narrower sheets and these narrower sheets are rolled up by a rolling device on a plurality of roll formers or spools, etc. that are disposed next to one another axially. When the winding of a roll on a roll former is completed, the wound roll is removed from the rolling device, the sheet which is still attached to the storage roll is torn off and the sheet header or leading end thus formed is attached to a newly inserted roll former or spool, normally by hand attachment with adhesive tape.

SUMMARY OF THE INVENTION

The object of the invention is to improve the ejection of a finished wound roll from the rolling device, insertion of a new roll former or spool and attachment of the new sheet header or leading end to the new roll former.

Another object is to relieve operating personnel of the need to perform the foregoing tasks manually.

It is a further object of the invention to reduce the down time needed for performing these tasks.

In the rolling device according to the invention, there are two supporting rollers that support the roll former and the roll of sheet material being wound from below, with the roll former being held between the supporting rollers as the roll is being wound. Normally, the sheet to be rolled up runs below the rearmost supporting roller, with respect to the direction of travel of the sheet from the sheet supply, around the front of that rear roller and between the two supporting rollers.

The objects of the invention are achieved according to the invention in that a wound roll lifting device lifts a finished or wound up roll off one of its two supporting rollers, and particularly off the supporting roller that is located at the rear, and lifts the finished roll partiall over the supporting roller located at the front with respect to the direction of travel of the sheet. The front supporting roller is rotated during this lifting operation so that the wound roll moving over the front roller does not turn in the winding direction. The above described action moves the sheet being rolled such that the sheet can engage a part of the circumference of a newly inserted roll former or spool. A loop of sheet material develops between the wound roll and the supporting rollers during the lifting operation. This loop provides the part of the sheet that engages the new roll former and the loop also provides room for motion of a stapling device.

A stapling device is movable to staple the engaging part of the sheet to the part of the circumference of the new roll former receiving the sheet. Suitable stapling means for the stapling device are staples, short nails and pins. It is expedient to dispose the stapling device so as to be pivotable about the axis of rotation of the rear supporting roller, since this means that only a small volume is required to accommodate the motion of the stapling device.

The rolling device may further include a dividing device disposed so as to be movable back and forth across the sheet between the rear supporting roller and the raised, finished wound roll for perforating or completely dividing the sheet along a path at right angles to the direction of sheet travel at a point lying between the raised wound roll and the part of the sheet that was just stapled to the newly inserted roll former. This means that the line along which the sheet is cut or torn off after it has been perforated is precisely defined and that the division of the sheet can be effected faster and can even be automated.

The dividing device and the stapling device can be located on a common mechanism by which they can be moved in and out together.

Preferably, the rolling device according to the invention also includes a feeder for the roll formers or spools, which feeder is disposed at an axial end of and facing toward the supporting rollers. The feeder has a magazine for holding roll formers and a conveyor. The conveyor extracts the roll formers from the magazine and feeds them into the gap that separates the supporting rollers so that each roll former is supported from below.

The invention makes it possible to effect an entire operation from the insertion of a new roll former to the removal of a finished wound roll automatically.

Other objects and features and two examples of the invention are illustrated in the accompanying drawings and are described below.

DESCRIPTION OF A PREFERRED EMBODIMENT

Figures 1, 1A, 2:
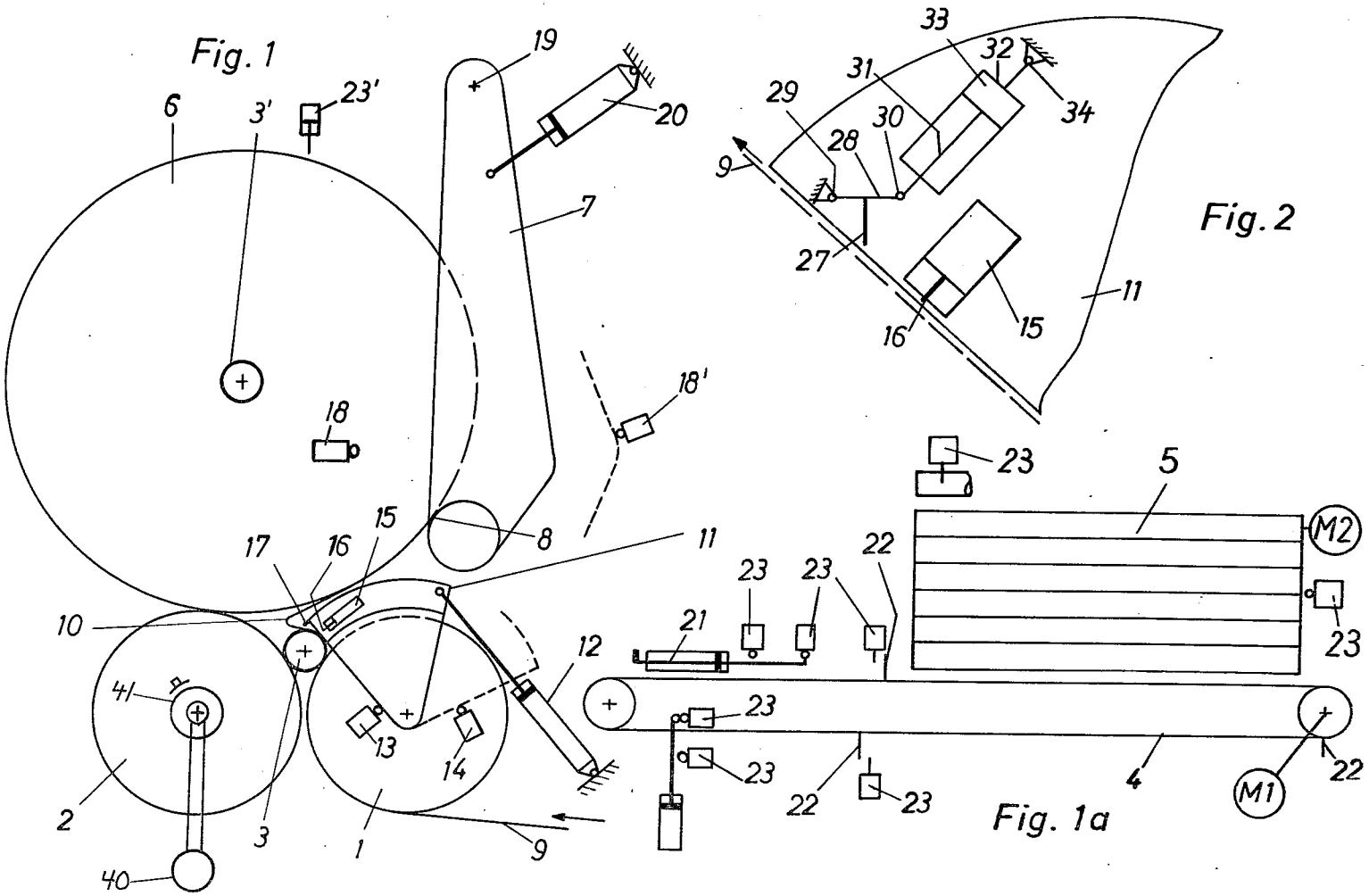
FIG. 1 is a schematic side elevational view of a rolling device in accordance with the invention.
FIG. 1*a* is a schematic side elevational view of a feeder for roll formers that is shown at an orientation perpendicular to its normal position relative to the supporting rollers in FIG. 1.
FIG. 2 is a schematic, partial view of a variant of a part of the rolling device in FIG. 1.

The rolling device shown in FIG. 1 comprises a rear supporting roller 1 and a front supporting roller 2 which are gap separated. The terms rear and front are with reference to the direction of travel of sheet 9. Means 40 drives at least one of the supporting rollers.

The Supporting rollers 1 and 2 of the rolling device of FIG. 1 can simultaneously support a plurality of roll formers 3 disposed one behind the other axially, whereby a plurality of roll formers 3 can be wound simultaneously. Sheet 9 is usually a paper sheet. A roll former or spool 3 is inserted between and extends parallel to the axes of rotation of the supporting rollers 1 and 2. The rollers 1 and 2 are close enough together that the roll former 3 is supported on both rollers, and it is supported from below. The rollers 1 and 2 are of a size and spacing such that with a below described wound roll 6 sitting on the rollers and with the wound roll 6 lifted as described below, there is enough space on the rollers 1 and 2 to receive and support a new roll former 3.

A roll former conveyor 4 is situated in front of one end of the rollers 1 and 2 so that the roll formers 3 can be pushed onto the supporting rollers along a parallel axis. The conveyor 4 feeds the roll formers 3 between rollers 1 and 2 from a magazine 5 disposed above the conveyor.

A previously wound, now finished, but as yet unseparated roll 6 which was wound on roll former 3' is shown. It is shown after it has been lifted forward away from the rear supporting roller 1 into the vicinity of and over the vertex of the front supporting roller 2. A discharge device 7 accomplishes this lifting movement and also prevents or brakes the roll 6 from turning while it is being lifted. The non-rotation or braking of the wound roll 6 is achieved partially through the front supporting roller 2 being free to turn during the lifting operation. The brake 41 on roller 2 is released. The discharge device 7 is brought to bear against the wound roll 6 under the center line of roll 6 at the point 8.

Because roll 6 does not rotate while it is being pushed out into the intermediate position illustrated in FIG. 1, this loosens the sheet 9 so that the sheet forms a loop in its section 10 between the finished roll 6 and the newly inserted roll former 3. The loop 10 ensures that the sheet 9 does not tear off at any uncontrollable point and that a stapling device 11 can be swung into the space formed between the rear supporting roller 1 and the wound roll 6.

The stapling device is supported to move about the axis of rotation of the rear supporting roller 1 in order to force stapling means, for example staples, short nails or pins, through the sheet 9 into the new roll former 3. This swinging movement of the stapling device is accomplished by a pressure medium drive 12. In the working position shown in solid lines, the stapling device 11 is resting against a limit switch 13, whereas in its starting position, which is indicated by the broken line, the stapling device rests on a limit switch 14.

The stapling device 11 has a magazine 15 for the stapling means 16, which are forced through the sheet 9 into the roll former 3 while the stapling device is in the position shown.

Once the sheet 9 has been stapled to the roll former, the front supporting roller 2 is prevented from turning by its brake 41 and the finished wound roll 6 is ejected over the front supporting roller 2 by continued forward motion of the roll lifting and discharge device 7. The discharge device 7 swings forwardly as far as a limit switch 18 and the roll 6 rolls over the front supporting roller 2 so that the sheet loop 10 tautens and is torn off along a tearing edge 17 that is provided on the stapling device. The torn off edge 17 on the end of the wound roll 6 defines the new leading end or header of the sheet 9 for attachment to the new roll former 3. After this, the stapling device swings rearwardly as far as a limit switch 14 and the discharge device 7 swings rearwardly as far as a limit switch 18' into its starting position. The swinging of the discharge device 7 about an axle 19 is caused by a pressure medium piston drive 20.

Now, the newly inserted roll former 3 to which sheet 9 has been stapled can be driven by the supporting rollers 1 and 2 and the sheet 9 can be rolled onto the new roll former 3.

A sensor 23' senses when a sufficient length of sheet material has been wound onto the roll former 3 and when the wound roll 6 is thus finished.

Returning to FIG. 1*a*, a positioning cylinder 21 located at the discharge end of the conveyor 4, ensures that each roll former 3 is pushed forward far enough. The magazine 5 can hold roll formers 3 that are of different lengths. Driving elements 22 on the conveyor and sensors 23 ensure that the roll formers 3 of different lengths are passed onto the supporting rollers 1 and 2 in the right order in each case. As a result, roll formers 3 of different lengths can be wound simultaneously in one fully automatic operation and can be replaced with new roll formers when they are fully wound.

Generally, the rolling process performed by the above described rolling device takes place in the following stages:

(a) Rotation of the roll former 3 that is then lying on the supporting rollers 1 and 2 and to which the beginning of the sheet 9 has been attached, such rotation being caused by driving at least one of the two supporting rollers 1, 2 by means 40;

(b) stopping the supporting rollers 1, 2 once the roll former 3 has been wound full (like wound roll 6 on roll former 3');

(c) insertion of a new roll former 3 from the magazine 5 onto the two supporting rollers 1, 2 by the conveyor 4;

(d) switching the front supporting roller 2 to allow it to run freely, preferably by releasing a brake on that roller;

(e) forcing the finished wound roll 6 with the aid of the discharge device 7 as far as an intermediate position just before the vertex of the front supporting roller 2 turning with it, while perventing turning of the wound roll 6, so that a loop 10 forms in the sheet 9;

(f) moving the stapling device 11 into the space between the rear supporting roller 1 and the wound roll 6 up to the newly inserted roll former 3 and forcing stapling means 16 through the sheet 9 into the roll former 3;

(g) perforating or completely dividing the sheet 9 between the finished wound roll 6 and the new roll former 3 simultaneously with stage "f" or afterward;

(h) stopping or braking the front supporting roller 2 so that it cannot turn any more and discharging the finished wound roll 6 by means of the discharge device 7 such that the wound roll 6 rolls over the stationary front supporting roller 2 and out of the rolling device.

Then the working stages (a) to (h) are repeated.

In accordance with a second embodiment of the invention, the dividing device is not a tear-off edge 17, but instead comprises cutters 27 that can be swung into the path of the sheet 9. The cutters can also be individual needles. The cutters 27 are disposed in a row one behind another, are arranged parallel to the supporting rollers 1 and 2 and are supported on an arm 28. One end of the arm 28 is pivotally mounted on a stationary pivot point 29 on the stapling device 11. The other end of the arm 28 is connected with the piston 31 of a pneumatic or hydraulic actuator 32 by a link 30. The cylinder 33 of the actuator 32 is fixed so as to be able to swing in a fixed mounting 34 on the stapling device 11.

With the dividing device shown in FIG. 2, the cutters 27 normally are in the retracted position of FIG. 2, in which they cannot reach the sheet 9. The cutters 27 are swung into the path of the sheet 9 by the piston 31, which is timed to advance when the finished roll 6 is being rolled out of the rolling device over the vertex of the front supporting roller 2 by the discharge device 7, whereby the sheet 9 is perforated by the cutters 27 and can be torn off.

Although the present invention has been described in connection with a number of preferred embodiments thereof, many variations and modifications will now become apparent to those skilled in the art. It is preferred, therefore, that the present invention be limited not by the specific disclosure herein, but only by the appended claims.

What is claimed is:

1. A rolling device for rolling up sheet material, comprising:

two supporting rollers arranged near to each other and defining a gap therebetween of a width with respect to the width of a roll former such that a roll former may be supported on both said supporting rollers over the gap; one of said rollers being the rearward roller with respect to the direction in which sheet material is fed to said rollers and the sheet material passes around said rearward roller and is then wrapped about a roll former supported on said supporting rollers; means for rotating a roll former supported on said rollers;

roll lifting means for engaging a finished roll that was wound about a roll former and that is supported on said supporting rollers and for lifting the finished roll off said rear roller and for moving the finished roll further toward said front roller while the sheet material still remains attached to the finished roll, thereby to cause the sheet material to form and define a section of the sheet material to be looped around a portion of and then attached to another roll former that is supported on said supporting rollers over the gap;

means for attaching the sheet material at the section thereof to the other roll former.

2. The rolling device of claim 1, wherein said means for attaching comprises a stapling device positioned and movable to engage and to staple the section of sheet material to a roll former that is supported on said supporting rollers.

3. The rolling device of claim 2, further comprising respective pivots for said supporting rollers and said supporting rollers being mounted on said respective pivots; said stapling device being pivotally mounted on said pivot of said rear roller, and said stapling device pivoting between its said position in engagement with a roll former and its position away from such engagement.

4. The rolling device of claim 1, further comprising a roll former feeder positioned and adapted to feed roll formers axially with respect to said supporting rollers onto said supporting rollers.

5. The rolling device of claim 4, wherein said feeder comprises a magazine for carrying roll formers and comprises a conveyor for conveying roll formers from said magazine onto said supporting rollers.

6. The rolling device of claim 1, wherein said roll lifting means further comprises finished roll braking means for preventing rotation of the finished roll in the roll winding direction as it is being lifted by said roll lifting means, thereby to form the section of sheet material as a loose loop of sheet material having a size to be in engagement with a new roll former carried on said supporting rollers.

7. The rolling device of claim 6, wherein said means for attaching comprises a stapling device positioned and movable to engage and to staple the loose loop section of sheet material to a roll former that is supported on said supporting rollers; respective pivots for said supporting rollers and said supporting rollers being pivotally mounted on said respective pivots; said stapling device being pivotally mounted on the respective pivot of said rear supporting roller, and said stapling device pivoting between its position in engagement with a roll former and its position away from such engagement.

8. The rolling device of claim 7, further comprising a dividing device for dividing the sheet material, and being positioned between said one supporting roller and the lifted finished roll for dividing the sheet material between the lifted finished roll and a new roll former that is carried on said supporting rollers.

9. The rolling device of claim 8, wherein said stapling device and said dividing device are attached to move together.

10. The rolling device of claim 7, further comprising a roll former feeder positioned and adapted to feed roll formers axially with respect to said supporting rollers onto said supporting rollers.

11. A method of rolling sheet material onto roll formers, comprising the steps of:

(a) placing a roll former on and between two supporting rollers wherein one of the rollers is rearward with respect to the direction in which the sheet material is fed to the rollers and the other roller is the forward roller;

(b) feeding the sheet material in the feeding direction and passing the sheet material around the rearward roller and to the roll former and attaching the sheet material to the roll former;

(c) rotating the roll former to wind sheet material thereon;

(d) halting the roll former rotation after a roll has been completely wound thereon;

(e) lifting the wound roll away from engagement with the rear roller and over the forward roller while braking the wound roll against rotation, thereby forming a loop in the sheet material;

(f) emplacing a new roll former on the supporting rollers and causing the loop in the sheet material to engage the new roll former;

(g) attaching the sheet material at the loop to the new roll former.

12. The method of claim 11, wherein said halting of the wound roll comprises allowing the front supporting roller to run freely while causing the wound roll to stay in engagement with the front roller as the wound roll is lifted.

13. The method of claim 12, further comprising (h) halting the front supporting roller against further rotation after the wound roll has been lifted and the loop of sheet material has been formed; and (i) ejecting the wound roll over the halted supporting roller.

14. The method of claim 11, wherein said (g) attaching is done by stapling the sheet material to the roll former.

15. The method of claim 11, wherein said (g) attaching is accomplished in the loop of sheet material between the other rear roller off which the wound roll is lifted and the wound roll.

16. The method of claim 11, further comprising (j) dividing the sheet material between the wound roll and the new roll former.

17. The method of claim 16, wherein said (j) dividing is accomplished at the same time as said (g) attaching.

18. The method of claim 17, further comprising (h) halting the other supporting roller against further rotation after the wound roll has been lifted and the loop of sheet material has been formed; and (i) ejecting the wound roll over the halted supporting roller.

19. The method of claim 11, further comprising (h) halting the other supporting roller against further rotation after the wound roll has been lifted and the loop of sheet material has been formed; and (i) ejecting the wound roll over the halted supporting roller.

20. The method of claim 11, wherein said (f) emplacing comprises conveying said roll former from a magazine to said supporting rollers.

21. The method of claim 11, wherein said (f) emplacing precedes said (e) lifting.

22. The method of claim 8, wherein said (f) emplacing comprises conveying said roll former from a magazine to said supporting rollers.

23. The rolling device of claim 6, wherein said finished roll braking means comprises a brake for said front roller which is selectively operable to halt and to permit rotating of said front roller.

* * * * *